US005083790A

United States Patent [19]

Wheatley

[11] Patent Number: 5,083,790

[45] Date of Patent: Jan. 28, 1992

[54] GOLF SWING TRAINING STICK

[76] Inventor: John Wheatley, 1487 Farmington Ave., Farmington, Conn. 06032

[21] Appl. No.: 721,956

[22] Filed: Jun. 27, 1991

[51] Int. Cl.[5] ..... A63B 69/36

[52] U.S. Cl. ..... 273/193 A; 272/124

[58] Field of Search ..... 273/193 R, 193 A, 193 B, 273/194 R, 194 A, 194 B, 183 D, 186 A, 186 C, 81 A; 272/124

[56] References Cited

U.S. PATENT DOCUMENTS

| | | | |
|---|---|---|---|
| 1,524,196 | 1/1925 | Matthews | 273/193 A X |
| 1,846,671 | 2/1932 | Barrett | 273/80 |
| 1,904,750 | 4/1933 | Reach | 273/80 |
| 2,023,131 | 12/1935 | Gibson | 273/80 |
| 2,051,083 | 8/1936 | Hart | 273/81 A |
| 2,203,893 | 6/1940 | Chapman | 273/80 |
| 2,950,115 | 8/1960 | Hurdzan | 273/186 |
| 3,231,281 | 1/1966 | Wallo | 273/193 A |
| 4,415,156 | 11/1983 | Jorgensen | 273/81 A |
| 4,819,935 | 4/1989 | Dirksing et al. | 273/193 A X |
| 4,878,673 | 11/1989 | Pollard | 273/193 A |
| 4,889,343 | 12/1989 | Nielsen | 273/186 A |

*Primary Examiner*—George J. Marlo

[57] ABSTRACT

A golf swing training device includes a handgrip which is comfortably gripped by both hands of the user and an elongated tublar member secured to one end of the handgrip and providing a total length of 33–44 inches. A weight is fixed in the tubular member and provides a total weight of 1.25–5.0 pounds and a fixed balane point at 16–18 inches from the outer end of the handgrip.

16 Claims, 2 Drawing Sheets

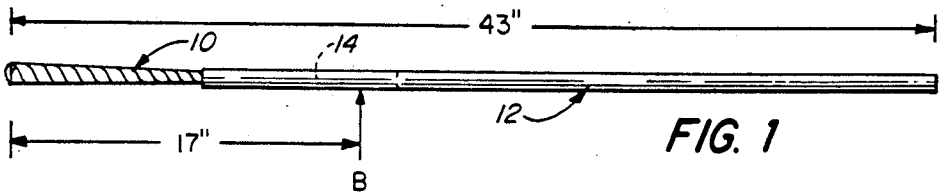
FIG. 1
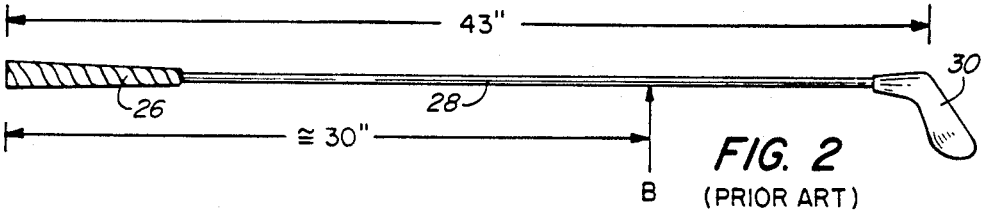
FIG. 2
(PRIOR ART)
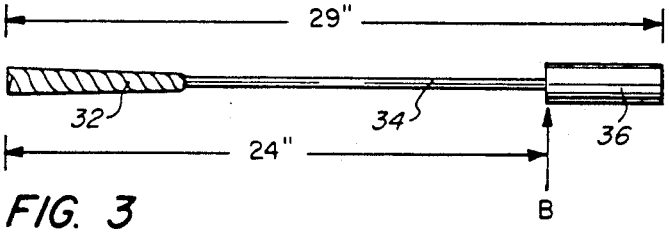
FIG. 3
(PRIOR ART)
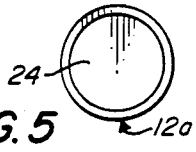
FIG. 5
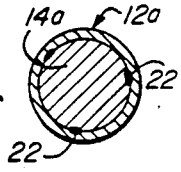
FIG. 6
FIG. 4
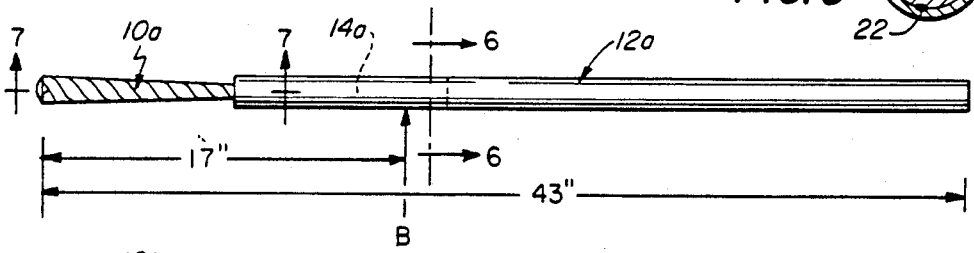
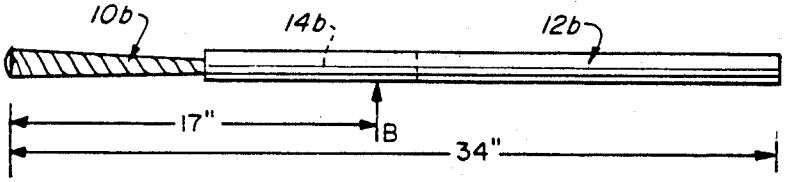
FIG. 8
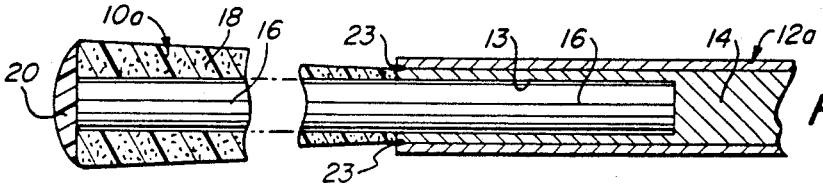
FIG. 7

GOLF SWING TRAINING STICK

BACKGROUND OF THE INVENTION

The present invention is directed to golf training devices and, more particularly, to a training device for improving a golfer's swing.

As is extensively reported in the literature, and as is the subject matter of training by golf professionals, the swing employed by a golfer Is extremely important to the golfer's performance in controlling the direction and length of travel of the golf ball. Factors involved include the strength of the golfer's grip on the club, the golfer's posture, the control of the plane in which the down swing and follow through occur, and the ability to keep the hands in a position in advance of the club head during the down swing to impact.

A number of devices have been developed for purposes of assisting a golfer in developing his or her swing, and a number of devices have been added to conventional golf clubs in an effort to control the swing. Illustrative of the golf swing training devices are Nielsen U.S. Pat. No. 4,889,343 which has a weighted and pivoted shank portion depending from the handgrip, and Hurdzan U.S. Pat. No. 2,950,115 which provides a weight adjacent the club head. Chapman U.S. Pat. No. 2,203,893 provides a practice club which has a weight that slides along the shaft of the club from a point adjacent the handgrip to a point adjacent the head. Although these devices may provide some benefit to persons using them, they fail to provide the full range of control desirable for a training device.

It is an object of the present invention to provide a novel golf swing training device which will strengthen the golfer's grip and cause the golfer's hands to lead the device during the down swing so as to train the golfer to present the entire club at impact and not just the club head.

It is also an object to provide such a golf swing training device which may be fabricated readily and which is adaptable to use by both men and women.

Another object is to provide such a golf swing training device which may be modified for use indoors or outdoors, and which will exhibit long life.

SUMMARY OF THE INVENTION

It has now been found that the foregoing and related objects may be readily attained in a golf swing training device comprising a handgrip of a length to be comfortably gripped by both hands of the user, and an elongated tubular member having one end secured to one end of the handgrip and a total length of 33–44 inches for the device. A weight is fixed in the tubular member to provide a total weight for the device of 1.25–5.0 pounds, and the weight provides a fixed balance point at 16–18 inches from the other end of the handgrip.

Preferably, the tubular member is of annular configuration and the weight is a cylindrical element secured in the tubular member. Both the tubular member and weight are metallic, and the weight is welded to the tubular member. Desirably, the device includes a plug sealing the other end of the tubular member.

In the preferred structure, the handgrip includes a metallic rod having one end engaged with the tubular member and a relatively soft material extending thereabout. The soft material is conveniently provided by a cylindrical sleeve of synthetic resin, and the metallic rod is welded to the tubular member.

The total length of the device is 33–35 inches for a device to be used indoors, and its total weight of the device is about 3½ pounds. The total length of the device is 42–44 inches for a device to be used outdoors, with in the total weight being about 1½ pounds for use by women and about 4 pounds for use by men.

BRIEF DESCRIPTION OF THE DRAWINGS

FIG. 1 is a side elevational view of a golf swing training device embodying the present invention;

FIG. 2 is a side elevational view of a prior art club;

FIG. 3 is a side elevational view of a prior art swing training device;

FIG. 4 is a side elevational view of another embodiment of the swing training device of the present invention;

FIG. 5 is an end elevational view thereof;

FIG. 6 is a cross sectional view thereof along the lines 6—6 of FIG. 4;

FIG. 7 is a fragmentary sectional view thereof along the lines 7—7 of FIG. 4;

FIG. 8 is a side elevational view of still another embodiment of the swing training device of the present invention.

DETAILED DESCRIPTION OF THE PREFERRED EMBODIMENT

Figures 9A, 9B, 9C, 9D, 9E, 9F, 9G, 9H, 9I:
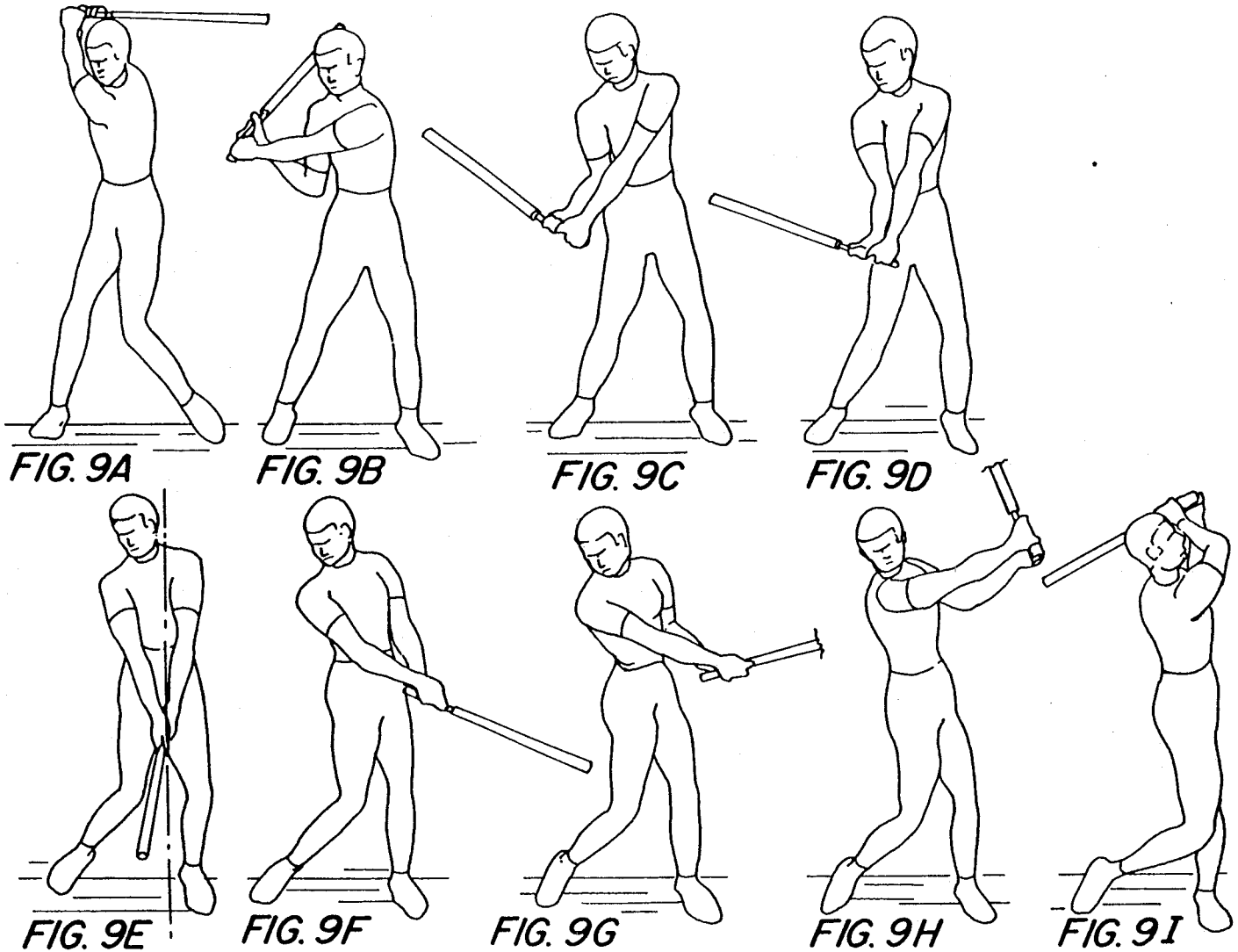
FIGS. 9A–9I are schematic illustrations showing the body motion of a person using a swing training device of the present invention.

Turning first to FIG. 1, therein illustrated is a swing training device embodying the present invention, and having an elongated handgrip generally designated by the numeral 10 and an elongated shaft generally designated by the numeral 12 which is affixed thereto and extends therefrom. Disposed within the shaft 12 as indicated by dotted lines is a weight 14 which provides a balance point for the device at the point "B" which is spaced a distance of 17 inches from the free end of the handgrip 10. The embodiment shown in FIG. 1 is a relatively lightweight swing training device suitable for women to use in the outdoors. Its total weight is approximately 1½ pounds.

The embodiment illustrated in FIG. 4 is suitable for use by men in the outdoors. As can be seen, it is similarly comprised of elongated handgrip **10*a* and elongated tubular shaft 12*a*** which is of substantially larger diameter.

As seen in FIGS. 5 and 6, the tubular shaft **12*a* is of annular configuration, and the free or lower end thereof has a plug 24 seated therein to effect a seal of the passage extending thereinto. In FIG. 6, it can be seen that the weight 14*a* is tack welded at several points about its periphery as indicated by the numeral 22**.

As seen in FIG. 7, the handgrip **10*a* includes a rod 16 which extends into a bore or recess 13 at the upper end of the weight 14, the several elements being welded as indicated by the numeral 23. Frictionally engaged about the rod 16 is a tubular sleeve 18 of soft synthetic resinous material, and an end cap 20** is provided at the outer end thereof and secured thereto by adhesive or the like.

In FIG. 8 there is illustrated still another embodiment of the present invention suitable for use indoors which is essentially similar to FIG. 4 except that the overall length is shortened, and the weight 14 is moved slightly away from the handgrip 10*b* to maintain the balance point at approximately the same position.

FIGS. 2 and 3 illustrate the prior art. In FIG. 2, a conventional club is illustrated having a handgrip 26, an elongated shaft 28, and a head 30. The balance point of this particular device is located much closer to the head 30 than to the handgrip 26. A typical length is about 43 inches and the resulting balance point will be about 30 inches from the end of the grip.

In the prior art swing training device as shown in FIG. 3, there is a handgrip 32, an elongated shaft 34, and a weight 36 at the end thereof. This device has an overall length of 29 inches and a length to the balance point of approximately 24 inches.

In each of the embodiments of FIGS. 1, 4 and 8, the balance point is located at a distance of approximately 17 inches from the free end of the handgrip 10.

As is well known to those who are engaged in the training of golfers, advancement at any skill level is dependent upon the hand strength or ability to grip the club firmly, the ability to swing through a correct plane angle, the ability to maintain a stable posture, and the ability to keep the hands in front of the club head during the down swing to impact.

FIGS. 9A through 9I illustrate the manner in which the swing training device cooperates with the correct posture, swing plane angle and placement of the hands as the golfer moves the club through the stroke. The swing training device of the present invention is weighted to locate the center of balance close to the handgrip so that the user swinging the club will normally have the club balanced in the hands so that the hands will lead the stick during the down swing. As a result and as seen in FIG. 5, this will result in presenting the entire training device at impact and not just the club head.

Moreover, the balance point adjacent the handle provides a high moment located towards the hands. This will tend to strengthen the hands when swung, keep the motion of the hands powerful through the impact zone, and carry the hands, arms and body to a high powerful finish, all as illustrated in the diagrammatic illustrations of the golfer seen in FIGS. 9A through 9I.

Although the handgrip rod and the elongated shaft may be fabricated from other materials such as reinforced synthetic resins, tubular metallic stock is preferably employed because of the ease of fabrication, its inherent strength, and the ease of assembling and positioning the weight and other elements by welding or like techniques.

Moreover, the elongated shaft is of annular configuration to facilitate the placement of the weight in the desired position along the length thereof and thereafter its welding oz engagement in that position. The handgrip desirably uses rod or bar stool to facilitate the assembly of the handgrip within the end of the shaft while providing the desired degree of strength.

For example, in the devices of FIGS. 4 and 8, the shaft is conveniently tubing of 1 and 1/16 inches outer diameter and 15/16 inch inner diameter and the rod is ⅝ inch diameter bar stock. Although weld metal may fill the spacing between the rod and shaft, a bushing may be placed therebetween.

The weight may be fabricated of various metals providing relatively high density including ferrous metals and lead. The length will vary depending upon the diameter of the passage in which seated, and the desired weight. As indicated above, its placement within the length of the shaft will depend upon the total weight of the device since it may be moved in either direction in order to provide a balance point within the range of 16–18 inches from the end of the handgrip as previously described.

The soft comfortable gripping surface is provided to the handgrip by a molded cylindrical sleeve simulating a leather wrap and generally fabricated from a cellular synthetic resin. The sleeve may be expanded to enable its placement over the grip rod, and it can be adhered thereto with a layer of adhesive or frictional engagement may be relied upon. To provide an attractive end finish for the grip, a synthetic resin end cap is adhesively engaged thereon.

The end seal at the lower end of the rod or shaft is conveniently a metallic plug or like element which is welded in place. However, a synthetic resin plug may also be employed to preclude dirt and other materials from entering into the hollow core of the shaft.

As will be readily appreciated, the elements described above may be readily assembled and comprise materials which are readily available. Depending upon the thickness of the shaft and of the rod of the grip, and the resultant weight of those two elements, the mass desired for the weight to be placed within the tubular shaft can be determined, and a length of solid bar stock cut to provide that weight. The balance point for the device can be readily determined by sliding the weight within the tubular shaft until the desired balance point is reached, and the weight can then be secured in place. Alternatively, the placement of the weight can be determined empirically based upon the known weight of the various elements. Once determined, swing devices of the same length and weight can readily be fabricated without such adjustment and/or continuing determinations.

Since most women prefer, and are better able to use, lighter clubs than those utilized by men, the swing training device for men will generally be heavier than that employed for women, although the balance point will be at essentially the same location from the end of the grip. For men, the training device will desirably have a total weight of 3–5 pounds, and preferably about 4 pounds. For women, the training device will normally have a weight of about 1¼ to 2½ pounds, and preferably about 1½ to 1¾ pounds.

Although the preferred swing training devices will normally have a length of about 40-44 inches, a device for use indoors will normally have a length 33-35 inches to reduce the likelihood of injury to ceilings and wells.

As indicated before, by having the balance point for the swing training device closely adjacent the hand grip, the user swinging the device generally tends to have the hands forwardly of the lower end of the device as the lowest point of the swing is being reached, a condition which is highly desirable when swinging with a regular club. Moreover, this balance point location tends to provide the desired follow through in the swing as well as to assist in maintaining proper body posture throughout the swing.

Thus, it can be seen from the foregoing detailed description and the attached drawings, that the golf swing training device of the present invention is one which may be readily fabricated from available materials to provide a long lived construction. The placement of the balance point adjacent the handgrip tends to force the user into adopting a proper swing relationship of the hands relative to the club during the down swing, and movement into the follow through. Thus, it helps to develop good posture and swing techniques.

Having thus described the invention, what is claimed is:

1. A golf swing training device comprising:
(a) a handgrip of a length to be comfortably gripped by both hands of the user;
(b) an elongated tubular member having one end secured to one end of said handgrip and a second free end, and providing with said handgrip a total length of 33–44 inches for the device; and
(c) a weight fixed in said tubular member and providing a total weight for the device of 1.25–5.0 pounds, said weight providing a fixed balance point for said device at a location within the range of 16–18 inches from the other end of said handgrip.

2. The training device in accordance with claim 1 wherein said tubular member is of annular configuration and said weight is a cylindrical element secured in said tubular member.

3. The training device in accordance with claim 1 wherein said tubular member and weight are metallic and said weight is welded to said tubular member.

4. The training device in accordance with claim 1 wherein said device includes a plug sealing the other end of said tubular member.

5. The training device in accordance with claim 1 wherein said handgrip includes a metallic rod having said one end engaged with said tubular member and a relative soft material extending thereabout.

6. The training device in accordance with claim 5 wherein said soft material is a cylindrical sleeve of synthetic resin.

7. The training device in accordance with claim 5 wherein said metallic rod is welded to said tubular member.

8. The training device in accordance with claim 1 wherein the total length of the device is 33–35 inches for a device to be used indoors.

9. The training device in accordance with claim 8 wherein the total weight of the device is about 3½ pounds.

10. The training device in accordance with claim 1 wherein the total length of the device is 42–44 inches for a device to be used outdoors.

11. The training device in accordance with claim 1 wherein the total weight of the device is about 1½ pounds for use by women.

12. The training device in accordance with claim 1 wherein the total length of the device is about 3.5 pounds for use by men.

13. A golf swing training device comprising:
(a) a handgrip of a length to be comfortably gripped by both hands of the user;
(b) an elongated tubular member of annular configuration having one end secured to one end of said handgrip and a second free end, and providing with said handgrip a total length of 33–44 inches for the device; and
(c) a cylindrical weight fixed in said tubular member and providing a total weight for the device of 1.25–5.0 pounds, said weight providing a fixed balance point for said device at a location within the range of 16–18 inches from the other end of said handgrip, said tubular member and weight being metallic and said weight being welded to said tubular member, said handgrip including a metallic rod having said one end engaged with said tubular member and a relatively soft material extending thereabout.

14. The training device in accordance with claim 13 wherein said device includes a plug sealing the other end of said tubular member.

15. The training device in accordance with claim 13 wherein said soft material is a cylindrical sleeve of synthetic resin.

16. The training device in accordance with claim 13 wherein said metallic rod is welded to said tubular member.

* * * * *